US009000688B2

(12) United States Patent
Wu

(10) Patent No.: US 9,000,688 B2
(45) Date of Patent: Apr. 7, 2015

(54) CONTROL CIRCUIT FOR LIGHT EMITTING DIODE OF DISPLAY

(75) Inventor: Hai-Zhou Wu, Shenzhen (CN)

(73) Assignees: Shenzhen Futaihong Precision Industry Co., Ltd., Shenzhen (CN); Chi Mei Communication Systems, Inc., New Taipei (TW)

( * ) Notice: Subject to any disclaimer, the term of this patent is extended or adjusted under 35 U.S.C. 154(b) by 222 days.

(21) Appl. No.: 13/517,570

(22) Filed: Jun. 13, 2012

(65) Prior Publication Data

US 2013/0175951 A1 Jul. 11, 2013

(30) Foreign Application Priority Data

Jan. 11, 2012 (CN) ..... 2012 1 0007114

(51) Int. Cl.
*H05B 41/00* (2006.01)
*H05B 33/08* (2006.01)

(52) U.S. Cl.
CPC ..... *H05B 33/08* (2013.01); *H05B 33/0803* (2013.01)

(58) Field of Classification Search
USPC ..... 315/33, 313, 291, 295, 297, 307–308; 323/234, 266, 282–284
See application file for complete search history.

(56) References Cited

U.S. PATENT DOCUMENTS

2005/0194915 A1* 9/2005 Elsheimer et al. ..... 315/291
2009/0015977 A1* 1/2009 Patel ..... 361/92

* cited by examiner

*Primary Examiner* — Douglas W Owens
*Assistant Examiner* — Henry Luong
(74) *Attorney, Agent, or Firm* — Novak Druce Connolly Bove + Quigg LLP

(57) ABSTRACT

A control circuit for light emitting diode (LED) of display includes a central processing unit (CPU), an AND gate, and a driving circuit. The CPU comprises a general purpose input output (GPIO) contact which outputs an instant high level voltage when a battery is installed into a portable electronic device. The AND gate includes a first input contact connected to the GPIO contact, a second input contact connected to a system power supply, and a first output contact. The system power supply outputs a low level voltage when the electronic device is powered off and outputs a high level voltage when the electronic device is powered on. The driving circuit includes a second output contact connected to an anode of the LED, a feedback contact connected to a cathode of the LED and an enable connected to the first output contact.

11 Claims, 1 Drawing Sheet

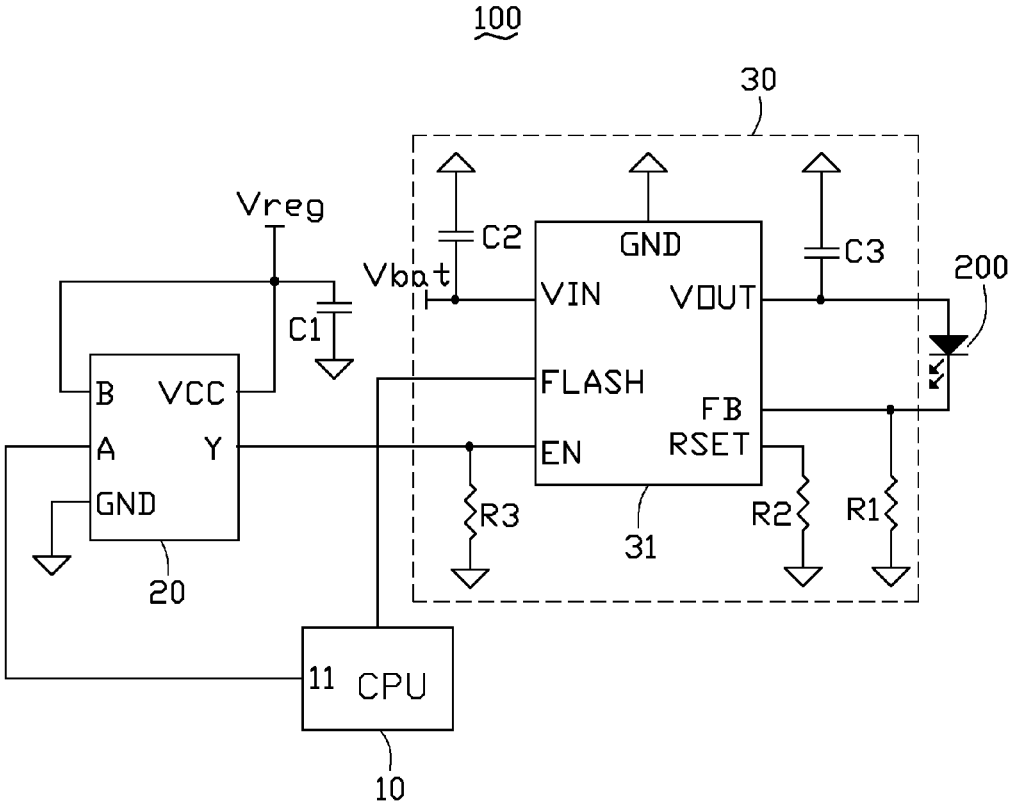
100
30
Vreg
C2
GND
C3
200
Vbat
VIN
VOUT
C1
FLASH
B
VCC
FB
A
Y
EN
RSET
GND
R3
R2
R1
31
20
11
CPU
10

CONTROL CIRCUIT FOR LIGHT EMITTING DIODE OF DISPLAY

BACKGROUND

1. Technical Field

The disclosure generally relates to control circuits for light emitting diodes (LEDs) of displays, and particularly to a control circuit for an LED of a display in a portable electronic device.

2. Description of Related Art

A typical portable electronic device includes a central processing unit (CPU) and an LED drive microchip configured for driving LEDs of a display. The CPU outputs a high/low level voltage from a general purpose input output (GPIO) contact to the LED drive microchip to turn on/off the LEDs.

However, when a battery is installed into the electronic device, the GPIO contact of the CPU may abnormally generate an instant high level voltage which lead to the LED instant flash, and finally forms an abnormal screen flicker on the display.

Therefore, there is room for improvement within the art.

BRIEF DESCRIPTION OF THE DRAWING

Many aspects of the present disclosure can be better understood with reference to the following drawing. The components in the drawing are not necessarily drawn to scale, the emphasis instead being placed upon clearly illustrating the principles of the disclosure.

The FIGURE is a circuit diagram of a control circuit for LED of display, according to an exemplary embodiment of the disclosure.

DETAILED DESCRIPTION

The FIGURE is a circuit diagram of a control circuit for LED of display, according to an exemplary embodiment of the disclosure. The control circuit 100 includes a CPU 10, an AND gate 20, and a driving circuit 30. The control circuit 100 is used to control an LED 200 of a display in a portable electronic device to turn on/off.

The CPU 10 includes a GPIO contact 11. The GPIO contact 11 controls the driving circuit 30 to turn on/off the LED 200 by the AND gate 20. When a battery is installed into the portable electronic device, the GPIO contact 11 abnormally outputs an instant high level voltage (i.e. logic 1). The instant high level voltage converts to a low level voltage (i.e. logic 0) after maintaining at the high level for a certain period such as 2 ms. After the battery is installed in the portable electronic device and the portable electronic device is powered on, the GPIO contact 11 can normally output a high level voltage or low level voltage to turn on/off the LED 200.

The AND gate 20 includes a power supply contact VCC, a first input contact A, a second input contact B, a first output contact Y and a ground contact GND. The power supply contact VCC is electrically connected to a system power supply Vreg. The system power supply Vreg outputs a low level voltage (e.g. 0V; i.e. logic 0) when the portable electronic device is powered off, and outputs a high level voltage (e.g. 1.8V; i.e. logic 1) when the portable electronic device is powered on. The first input contact A is electrically connected to the GPIO contact 11. The second input contact B is electrically connected to the system power supply Vreg, and grounded through a first capacitor C1. The first output contact Y is electrically connected to the driving circuit 30. The ground contact GND is grounded.

When the first input contact A and the second input contact B both receive high level voltage (i.e. logic 1), the first output contact Y outputs a high level voltage (i.e. logic 1). Otherwise, if either of the first input contact A or the second input contact B receives a low level voltage (i.e. logic 0), the first output contact Y outputs a low level voltage (i.e. logic 0).

The driving circuit 30 includes a driving microchip 31, a first resistor R1 and a second resistor R2. The driving microchip 31 includes an input contact VIN, a ground contact GND, a second output contact VOUT, a feedback contact FB, a flash mode set contact FLASH, a resistor set contact RSET and an enable contact En.

The input contact VIN is electrically connected to the battery, and obtains a battery power supply Vbat and grounded by a second capacitor C2. The ground contact GND is grounded. The second output contact VOUT is electrically connected to an anode of the LED 200. The feedback contact FB is electrically connected to a cathode of the LED 200. The second output contact VOUT drives the LED 200 to turn on/off. The second output contact VOUT is grounded by a third capacitor C3. The flash mode set contact FLASH is electrically connected to the CPU 10 and configured for setting flash modes of the LED 200 which may includes an instant flash mode and a continuous flash mode.

One end of the first resistor R1 is electrically connected to the feedback contact FB, and another end of the first resistor R1 is grounded. A light intensity of the LED 200 in the instant flash mode can be adjusted by changing the resistance of the first resistor R1. The resistor set contact RSET is grounded by the second resistor R2. The light intensity of the LED 200 in the continuous flash mode can be adjusted by changing the resistance of the second resistor R2.

The enable contact EN is electrically connected to the first output contact Y and grounded by the third resistor R3. In this embodiment, the enable contact En is enabled by a high level voltage, when the high level voltage is input to the enable contact EN, the driving microchip 31 drives the LED 200 to turn on; when a low level voltage is input to the enable contact EN, the driving microchip 31 cannot drive the LED 200 to turn on. The third resistor R3 divides a voltage output from the first output contact Y for the enable contact EN.

In this embodiment, the first capacitor C1, the second capacitor C2 and the third capacitor C3 are configured for reducing direct current portion of the system power supply Vreg, the battery Vbat and the output voltage of the second output contact VOUT.

When the battery is installed into the portable electronic device, the GPIO contact 11 outputs the instant high level voltage to the first input contact A. Meanwhile, the portable electronic device is powered off, and the system power supply Vreg outputs a low level voltage to the second input contact B. The first output contact Y outputs a low level voltage to the enable contact EN after a logic AND operation. Thus, the driving microchip 31 cannot drive the LED 200 to turn on, and an abnormal flash of the display can be avoided.

After the battery is installed into the portable electronic device and the portable electronic device is powered on, the CPU 10 can normally control the LED 200 to turn on/off by the GPIO contact 11. When the GPIO contact 11 outputs a low level voltage to the first input contact A, the system power supply Vreg outputs a high level voltage, the first output contact Y outputs a low level voltage to the enable contact EN. Thus, the driving microchip 31 cannot drive the LED 200 to turn on. When the GPIO contact 11 outputs a high level voltage to the first input contact A, the system power supply Vreg outputs a high level voltage; the first output contact Y outputs a high level voltage to the enable contact EN. Thus, the driving microchip 31 can drive the LED 200 to turn on.

The AND gate 20 and the system power supply Vreg convert the instant high level voltage generated when the battery is installed to the portable electronic device to a low level voltage, and then sends the low level voltage to the driving circuit 30 to avoid the abnormal flash of the display.

It is believed that the exemplary embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A control circuit for light emitting diode (LED) of display, the control circuit comprising:

a central processing unit (CPU), the CPU comprising a general purpose input output (GPIO) contact, the GPIO contact outputting a high level voltage;

an AND gate comprising a first input contact connected to the GPIO contact, a second input contact connected to a system power supply, and a first output contact, the system power supply outputting a low level voltage when a portable electronic device is powered off and outputting a high level voltage when the portable electronic device is powered on; and a driving circuit comprising a second output contact connected to an anode of the LED, a feedback contact connected to a cathode of the LED and an enable connected to the first output contact.

2. The control circuit of claim 1, wherein the driving circuit further comprises a flash mode set contact connected to the CPU, the CPU sets the LED to be in an instant flash mode or a continuous flash mode by the flash mode set contact.

3. The control circuit of claim 1, wherein the driving circuit further comprises a first resistor, one end of the first resistor is electrically connected to the feedback contact, and another end of the first resistor is grounded.

4. The control circuit of claim 1, wherein the driving circuit further comprises a resistor set contact and a second resistor, the resistor set mode contact is grounded by the second resistor.

5. The control circuit of claim 1, wherein the driving circuit further comprises a third resistor, the enable contact is grounded by the third resistor.

6. A control circuit for light emitting diode (LED) of display, the control circuit comprising:

a central processing unit (CPU), the CPU comprising a general purpose input output (GPIO) contact, the GPIO contact outputting an instant high level voltage;

an AND gate connected to the GPIO contact, the AND gate converting the instant high level voltage into a low level voltage;

a driving circuit connected the LED by the AND gate;

wherein the AND gate comprises a first input contact connected to the GPIO contact, a second input contact connected to a system power supply, and a first output contact, the system power supply outputs a low level voltage when a portable electronic device is powered off and outputs a high level voltage when the portable electronic device is powered on, the first output contact is connected to the driving circuit.

7. The control circuit of claim 6, wherein the driving circuit comprises a second output contact connected to an anode of the LED, a feedback contact connected to a cathode of the LED, and an enable connected to the first output contact.

8. The control circuit of claim 6, wherein the driving circuit further comprises a flash mode set contact connected to the CPU, the CPU sets the LED to be in an instant flash mode or a continuous flash mode by the flash mode set contact.

9. The control circuit of claim 6, wherein the driving circuit further comprises a first resistor, one end of the first resistor is electrically connected to the feedback contact, and another end of the first resistor is grounded.

10. The control circuit of claim 6, wherein the driving circuit further comprises a resistor set contact and a second resistor, the resistor set mode contact is grounded by the second resistor.

11. The control circuit of claim 6, wherein the driving circuit further comprises a third resistor, the enable contact is grounded by the third resistor.

* * * * *